US006314872B1

(12) United States Patent
Collins

(10) Patent No.: US 6,314,872 B1
(45) Date of Patent: Nov. 13, 2001

(54) HARD BOILED EGG SHELLING DEVICE

(76) Inventor: Turner W. Collins, 2735 Corprew Ave., #115, Norfolk, VA (US) 23504

( * ) Notice: Subject to any disclaimer, the term of this patent is extended or adjusted under 35 U.S.C. 154(b) by 0 days.

(21) Appl. No.: 09/616,925

(22) Filed: Jul. 14, 2000

(51) Int. Cl.[7] ..... A47J 43/14

(52) U.S. Cl. ..... 99/516; 99/568; 99/580; 99/582; 99/577

(58) Field of Search ..... 99/516, 568, 571, 99/580, 581, 582, 498

(56) References Cited

U.S. PATENT DOCUMENTS

| | | | | |
|---|---|---|---|---|
| D. 219,991 | | 2/1971 | De Varco | D33/30 |
| 1,618,682 | * | 2/1927 | Snapp | 99/568 X |
| 2,449,941 | | 9/1948 | Jauhianen | 99/516 |
| 2,466,310 | | 4/1949 | Gaylor | 99/516 |
| 3,301,290 | | 1/1967 | Scalella et al. | 99/472 |
| 3,951,055 | * | 4/1976 | Woebbeking | 99/568 |
| 4,056,051 | | 11/1977 | Brown | 99/516 |
| 4,182,234 | * | 1/1980 | Reed | 99/568 X |
| 4,344,359 | * | 8/1982 | Frechou et al. | 99/568 X |
| 4,787,306 | | 11/1988 | Johnson | 99/568 |

* cited by examiner

*Primary Examiner*—Reginald L. Alexander

(57) ABSTRACT

A hard boiled egg shelling device for quickly and easily removing the shell from a hard boiled egg. The hard boiled egg shelling device includes a supporting assembly for supporting a hard boiled egg which includes a support member having a base portion, an intermediate portion, and an upper portion spaced above the base portion; and also includes a shelling assembly for removing the hard boiled egg from its shell which includes a bellows mounted to the upper portion.

17 Claims, 4 Drawing Sheets

HARD BOILED EGG SHELLING DEVICE

BACKGROUND OF THE INVENTION

1. Field of the Invention

The present invention relates to a hard boiled egg sheller and more particularly pertains to a new hard boiled egg shelling device for quickly and easily removing the shell from a hard boiled egg.

2. Description of the Prior Art

The use of a hard boiled egg sheller is known in the prior art. More specifically, a hard boiled egg sheller heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,056,051; 3,301,290; 4,787,306; 2,466,310; 2,449,941; and U.S. Pat. No. Des. 219,991.

While these devices fulfill their respective, particular objectives and requirements, the aforementioned patents do not disclose a new hard boiled egg shelling device. The inventive device includes a supporting assembly for supporting a hard boiled egg which includes a support member having a base portion, an intermediate portion, and an upper portion spaced above the base portion; and also includes a shelling assembly for removing the hard boiled egg from its shell which includes a bellows mounted to the upper portion.

In these respects, the hard boiled egg shelling device according to the present invention substantially departs from the conventional concepts and designs of the prior art, and in so doing provides an apparatus primarily developed for the purpose of quickly and easily removing the shell from a hard boiled egg.

SUMMARY OF THE INVENTION

In view of the foregoing disadvantages inherent in the known types of hard boiled egg sheller now present in the prior art, the present invention provides a new hard boiled egg shelling device construction wherein the same can be utilized for quickly and easily removing the shell from a hard boiled egg.

The general purpose of the present invention, which will be described subsequently in greater detail, is to provide a new hard boiled egg shelling device which has many of the advantages of the hard boiled egg sheller mentioned heretofore and many novel features that result in a new hard boiled egg shelling device which is not anticipated, rendered obvious, suggested, or even implied by any of the prior art hard boiled egg sheller, either alone or in any combination thereof.

To attain this, the present invention generally comprises a supporting assembly for supporting a hard boiled egg which includes a support member having a base portion, an intermediate portion, and an upper portion spaced above the base portion; and also includes a shelling assembly for removing the hard boiled egg from its shell which includes a bellows mounted to the upper portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hard boiled egg shelling device which has many of the advantages of the hard boiled egg sheller mentioned heretofore and many novel features that result in a new hard boiled egg shelling device which is not anticipated, rendered obvious, suggested, or even implied by any of the prior art hard boiled egg sheller, either alone or in any combination thereof.

It is another object of the present invention to provide a new hard boiled egg shelling device which may be easily and efficiently manufactured and marketed.

It is a further object of the present invention to provide a new hard boiled egg shelling device which is of a durable and reliable construction.

An even further object of the present invention is to provide a new hard boiled egg shelling device which is susceptible of a low cost of manufacture with regard to both materials and labor, and which accordingly is then susceptible of low prices of sale to the consuming public, thereby making such hard boiled egg shelling device economically available to the buying public.

Still yet another object of the present invention is to provide a new hard boiled egg shelling device which provides in the apparatuses and methods of the prior art some of the advantages thereof, while simultaneously overcoming some of the disadvantages normally associated therewith.

Still another object of the present invention is to provide a new hard boiled egg shelling device for quickly and easily removing the shell from a hard boiled egg.

Yet another object of the present invention is to provide a new hard boiled egg shelling device which includes a supporting assembly for supporting a hard boiled egg which includes a support member having a base portion, an intermediate portion, and an upper portion spaced above the base portion; and also includes a shelling assembly for removing the hard boiled egg from its shell which includes a bellows mounted to the upper portion.

Still yet another object of the present invention is to provide a new hard boiled egg shelling device that allows the user to effectively separate the shell from the hard boiled egg.

Even still another object of the present invention is to provide a new hard boiled egg shelling device that reduces the amount of time to remove the shell from the egg.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
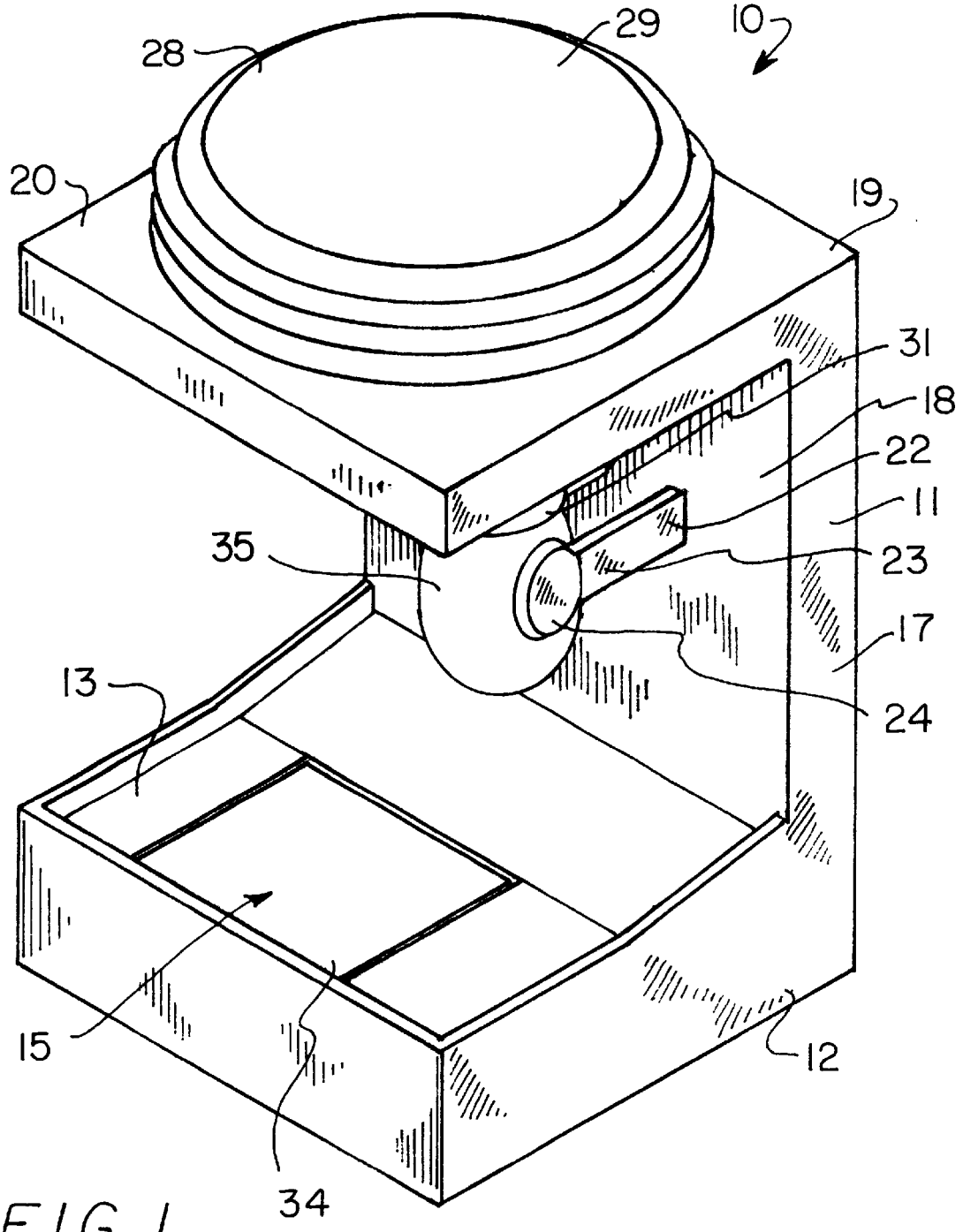
FIG. 1 is a perspective view of a new hard boiled egg shelling device according to the present invention.
Figure 2:
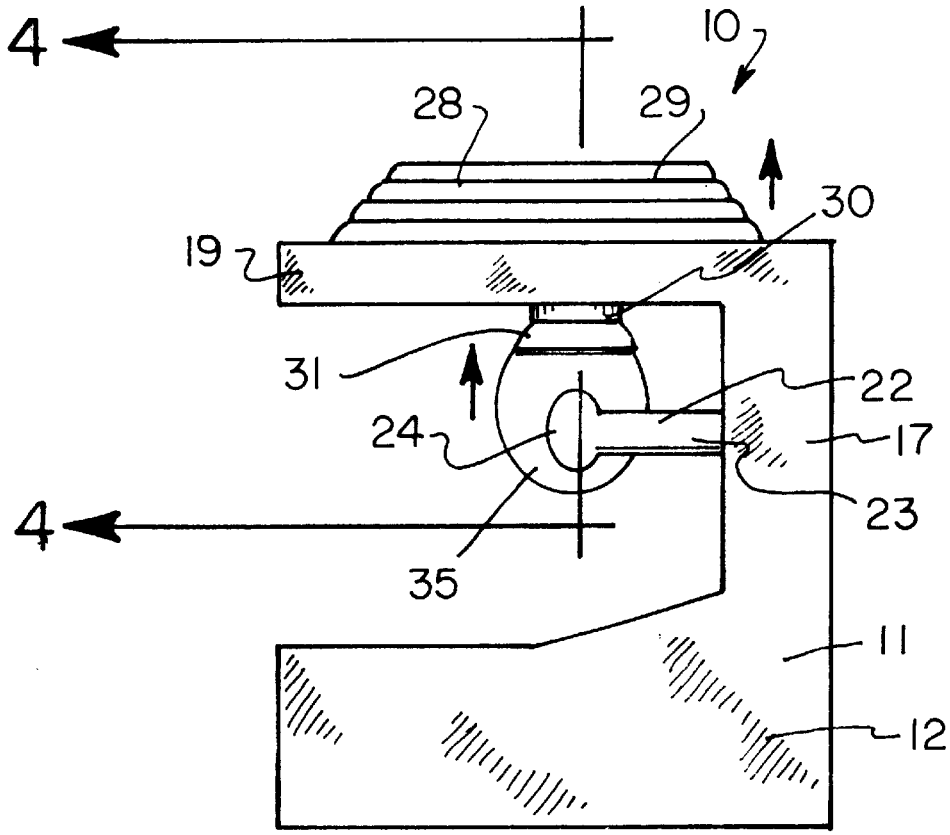
FIG. 2 is a side elevational view of the present invention shown in use.
Figure 3:
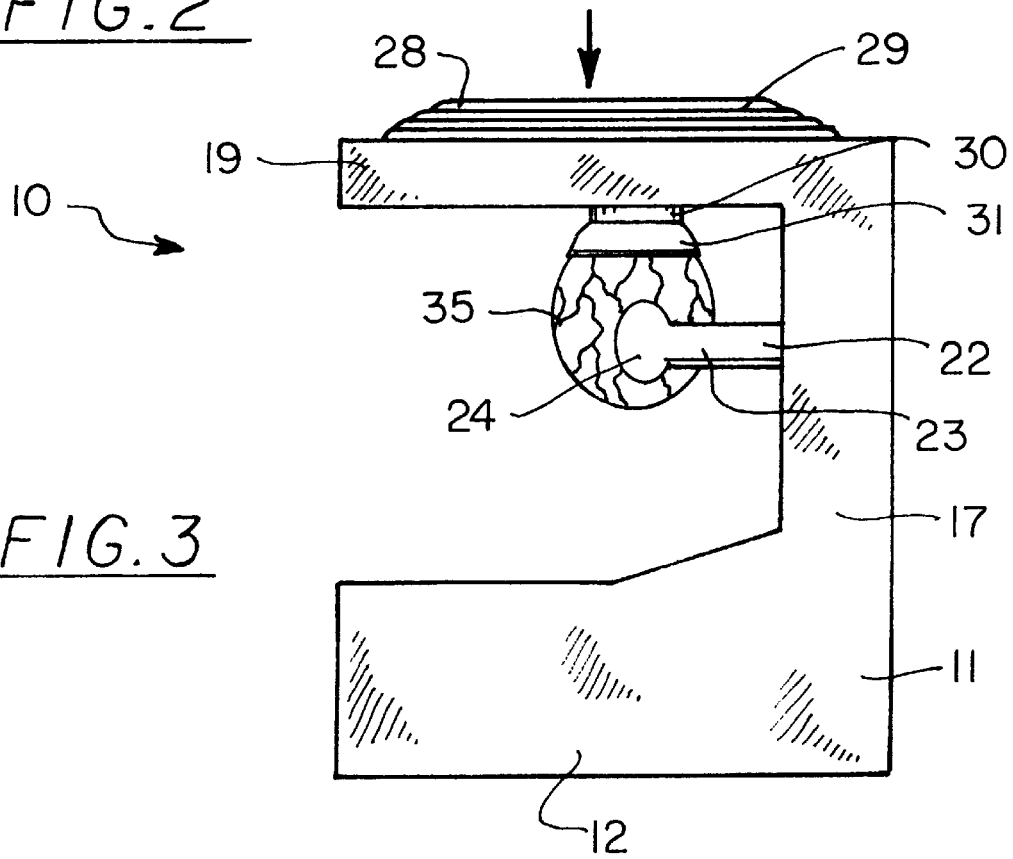
FIG. 3 is a side elevational view of the present invention shown with the shell of the egg being cracked.
Figure 4:
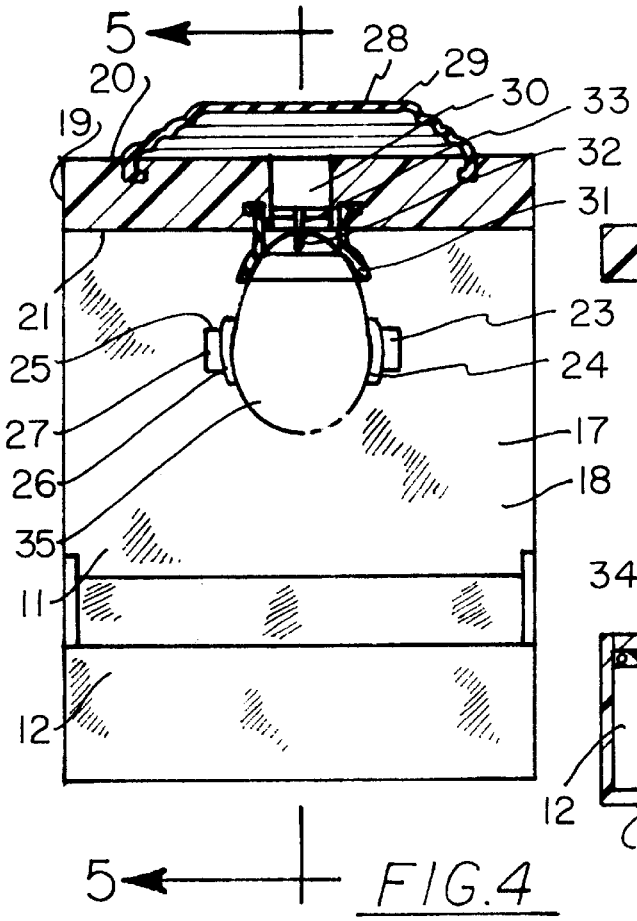
FIG. 4 is a front cross-sectional view of the third embodiment of the present invention.
Figure 5:
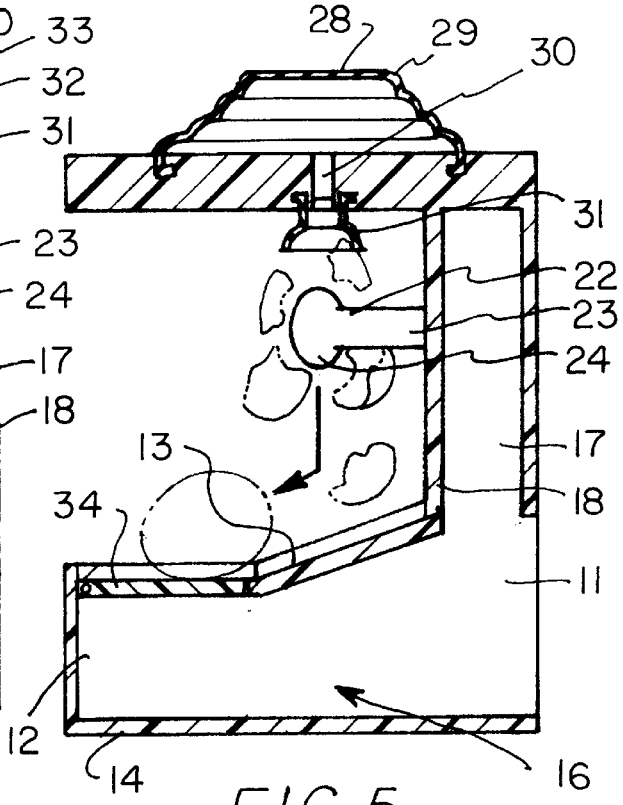
FIG. 5 is a side cross-sectional view of the present invention showing the cracking and dropping of the egg to the base portion.
Figure 6:
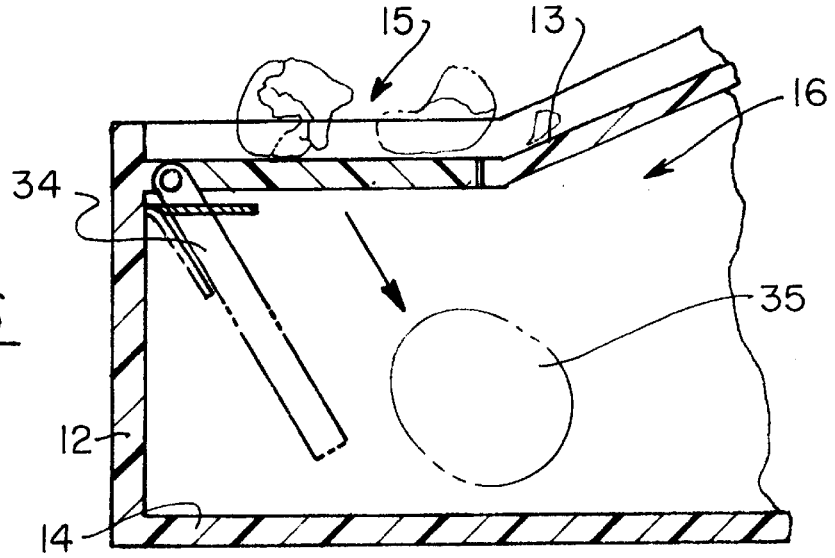
FIG. 6 is a partial cross-sectional view of the second embodiment of the present invention.
Figure 7:
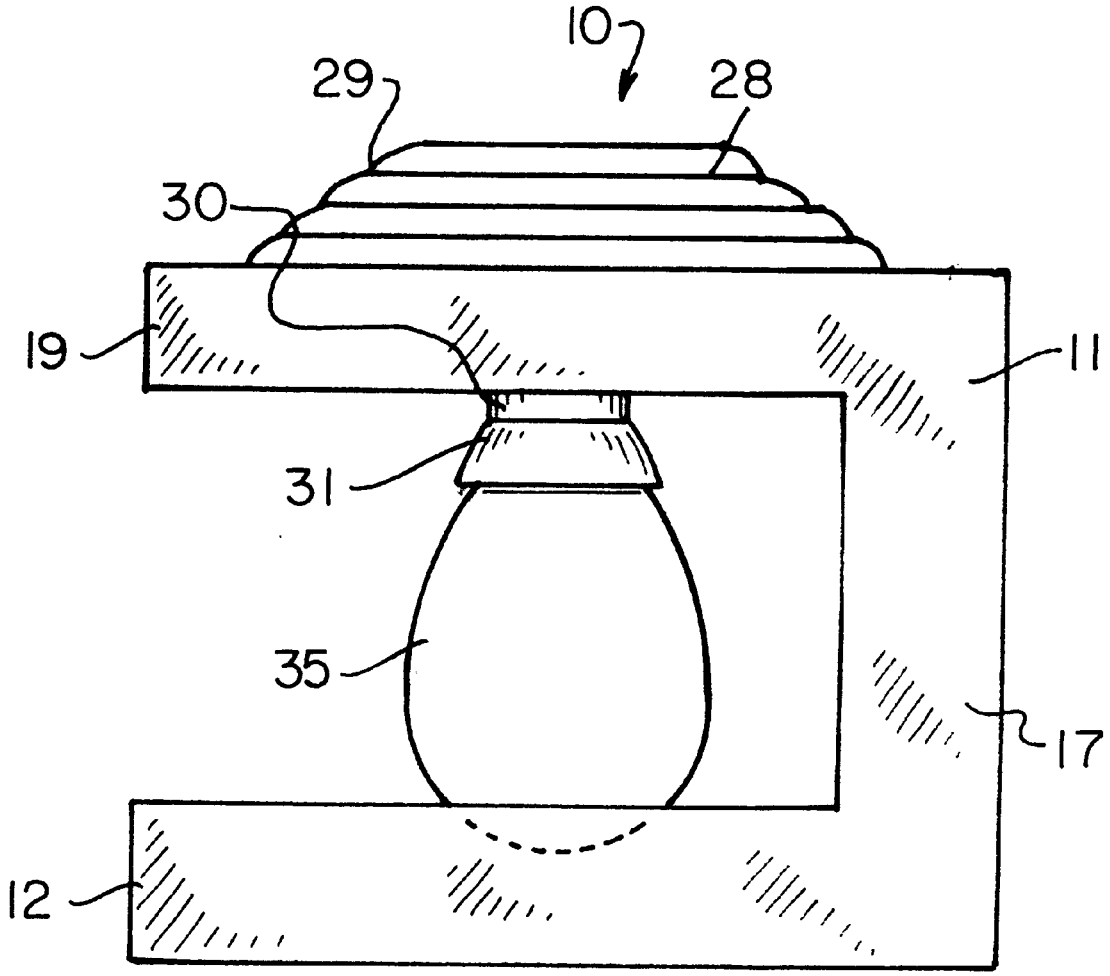
FIG. 7 is a side elevational view of another embodiment of the present invention.

With reference now to the drawings, and in particular to FIGS. 1 through 7 thereof, a new hard boiled egg shelling device embodying the principles and concepts of the present invention and generally designated by the reference numeral 10 will be described.

As best illustrated in FIGS. 1 through 7, the hard boiled egg shelling device 10 generally comprises a means for supporting a hard boiled egg including a support member 11 having a base portion 12, an intermediate portion 17 integrally extending upwardly from the base portion 12, and an upper portion 19 integrally extending outwardly from the intermediate portion 17 and being spaced above the base portion 12 and having an upper wall 20 and a lower wall 21 spaced from the upper wall 20. The means for supporting a hard boiled egg 35 includes a pair of egg clamping members 22,25 being spaced apart and being securely and conventionally attached to a wall 18 of the intermediate portion 17. The clamping members 22,25 extend outwardly from the wall 18 of the intermediate portion 17 below the upper portion 19 and being adapted to receive and hold the hard boiled egg 35 therebetween. Each of the clamping members 22,25 includes an arm 23,26 having a first end and a second end which is securely and conventionally attached to the wall 18 of the intermediate portion 17, and also includes an egg-engaging member 24,27 securely and conventionally attached to the second end thereof. The clamping members 22,25 are spaced from the upper 19 and base 12 portions of the support member 11.

A means for removing the hard boiled egg 35 from its shell includes a bellows 28 securely, expandably, contractably, and conventionally mounted to the upper wall 20 of the upper portion 19, and also includes a cap-like member 31 securely and conventionally attached to the bellows 28 and being adapted to securely fit or engage about a top portion of the hard boiled egg 35. The bellows 28 includes a flexible vessel 29 and a tubular member 30 integrally connected to and extending from the flexible vessel 29 and also extending through the upper 20 and lower 21 walls of the upper portion 19 of the support member 11. The cap-like member 31 is securely and conventionally attached to an end of the tubular member 30 and has a centrally-disposed opening 32 extending therethrough. The bellows 28 is adapted to create and force air through the tubular member 30 and through the opening 32 of the cap-like member 31. The cap-like member 31 is essentially flexible and is suspended below the lower wall 21 of the upper portion 19 of the support member 11.

As a second embodiment, the base portion 12 of the support member 11 includes a top wall 13 and a bottom wall 14 spaced from the top wall 13 thus forming a compartment 16 therebetween with the top wall 13 having an opening 15 therethrough. The support member 11 further includes a spring-loaded trap door 34 hingedly attached to the top wall 13 and biasedly closing the opening 15 in the top wall 13 of the base portion 12 and being adapted to allow the hard boiled egg 35 to open the spring-loaded trap door 34 and to be received in the compartment 16.

As a third embodiment, the means for removing the hard boiled egg 35 from its shell includes a shell-piercing member 33 securely and conventionally attached to an underside of the cap-like member 31 and being adapted to piece and crack the shell of the hard boiled egg 35.

In use, the user takes a warm hard boiled egg 35 and secures it between the clamping members 22,25 and to the cap-like member 31, and presses upon the flexible vessel 29 of the bellows 28 to create air which is forced through the tubular member 30 and cap-like member 31 onto the cracked hard boiled egg 35 which essentially peels the shell from the hard boiled egg 35 thus causing the hard boiled egg to drop to the base portion 12 and upon the trap door 34 and through the opening 15 in the top wall 13 of the base portion 12 and into the compartment 16 with the shell resting upon the top wall 13 of the base portion 12, because the shell is not heavy enough to open the spring-loaded trap door 34.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hard boiled egg shelling device comprising:

a means for supporting a hard boiled egg including a support member having a base portion, an intermediate portion extending upwardly from said base portion, and an upper portion extending outwardly from said intermediate portion and being spaced above said base portion and having an upper wall and a lower wall spaced from said upper wall;

a means for removing the hard boiled egg from its shell including a bellows securely, expandably, and contractably mounted to said upper wall of said upper portion; and also includes a cap-like member securely attached to said bellows and being adapted to securely fit or engage about a top portion of the hard boiled egg; and wherein said bellows includes a flexible vessel and a tubular member connected to and extending from said flexible vessel and also extending through said upper and lower walls of said upper portion of said support member, said cap-like member being securely attached to an end of said tubular member and having a centrally-disposed opening therethrough, said bellows being adapted to create and force air through said tubular member.

2. A hard boiled egg shelling device as described in claim 1, wherein said cap-like member is essentially flexible and is suspended below said lower wall of said upper portion of said support member.

3. A hard boiled egg shelling device as described in claim 1, wherein said means for supporting a hard boiled egg includes a pair of egg clamping members being spaced apart and being securely attached to a wall of said intermediate portion, said clamping members extending outwardly from said wall of said intermediate portion below said upper portion and being adapted to receive and hold the hard boiled egg therebetween.

4. A hard boiled egg shelling device as described in claim 3, wherein each of said clamping members includes an arm having a first end and a second end which is securely attached to said wall of said intermediate portion; and also includes an egg-engaging member securely attached to said second end thereof, said clamping members being spaced from said upper and base portions of said support member.

5. A hard boiled egg shelling device as described in claim 1, wherein said base portion of said support member includes a top wall and a bottom wall spaced from said top wall thus forming a compartment therebetween, said top wall having an opening extending therethrough.

6. A hard boiled egg shelling device as described in claim 5, wherein said support member further includes a spring-loaded trap door hingedly attached to said top wall and biasedly closing said opening in said top wall of said base portion and being adapted to allow the hard boiled egg to open said spring-loaded trap door and be received in said compartment.

7. A hard boiled egg shelling device as described in claim 1, wherein said means for removing the hard boiled egg from its shell also includes a shell-piercing member securely attached to an underside of said cap-like member and being adapted to piece and crack the shell of the hard boiled egg.

8. A hard boiled egg shelling device comprising:

a means for supporting a hard boiled egg including a support member having a base portion, an intermediate portion extending upwardly from said base portion, and an upper portion extending outwardly from said intermediate portion and being spaced above said base portion and having an upper wall and a lower wall spaced from said upper wall, said means for supporting a hard boiled egg including a pair of egg clamping members being spaced apart and being securely attached to a wall of said intermediate portion, said clamping members extending outwardly from said wall of said intermediate portion below said upper portion and being adapted to receive and hold the hard boiled egg therebetween, each of said clamping members including an arm having a first end and a second end which is securely attached to said wall of said intermediate portion; and also including an egg-engaging member securely attached to said second end thereof, said clamping members being spaced from said upper and base portions of said support member; and a means for removing the hard boiled egg from its shell including a bellows securely, expandably, and contractably mounted to said upper wall of said upper portion; and also including a cap-like member securely attached to said bellows and being adapted to securely fit or engage about a top portion of the hard boiled egg, said bellows including a flexible vessel and a tubular member connected to and extending from said flexible vessel and also extending through said upper and lower walls of said upper portion of said support member, said cap-like member being securely attached to an end of said tubular member and having a centrally-disposed opening therethrough, said bellows being adapted to create and force air through said tubular member, said cap-like member being essentially flexible and being suspended below said lower wall of said upper portion of said support member.

9. A hard boiled egg shelling device as described in claim 8, wherein said base portion of said support member includes a top wall and a bottom wall spaced from said top wall thus forming a compartment therebetween, said top wall having an opening extending therethrough, said support member further including a spring-loaded trap door hingedly attached to said top wall and biasedly closing said opening in said top wall of said base portion and being adapted to allow the hard boiled egg to open said spring-loaded trap door and be received in said compartment.

10. A hard boiled egg shelling device as described in claim 8, wherein said means for removing the hard boiled egg from its shell also includes a shell-piercing member securely attached to an underside of said cap-like member and being adapted to piece and crack the shell of the hard boiled egg.

11. A hard boiled egg shelling device comprising:

a means for supporting a hard boiled egg including a support member having a base portion, an intermediate portion extending upwardly from said base portion, and an upper portion extending outwardly from said intermediate portion and being spaced above said base portion;

a means for removing the hard boiled egg from its shell including a bellows mounted on said upper portion and a cap-like member for fitting against a top portion of the hard boiled egg, said bellows including a flexible vessel with an interior and a tubular member connected to and extending from said flexible vessel, said tubular member having a lumen in fluid communication with the interior of said flexible vessel, said flexible vessel being expandable and contractible to correspondingly expand and contract the interior of said flexible vessel, said cap-like member having an opening therethrough in fluid communication with the lumen of said tubular member and the interior of said flexible vessel such that expansion and contraction of said flexible vessel draws air into and forces air out of said opening in cap-like member.

12. A hard boiled egg shelling device as described in claim 11, wherein said cap-like member is essentially flexible and is suspended below said upper portion of said support member.

13. A hard boiled egg shelling device as described in claim 11, wherein said means for supporting a hard boiled egg includes a pair of egg clamping members being spaced apart and being attached to a wall of said intermediate portion, said clamping members extending outwardly from said wall of said intermediate portion below said upper portion and being adapted to receive and hold the hard boiled egg therebetween.

14. A hard boiled egg shelling device as described in claim 13, wherein each of said clamping members includes an arm having a first end and a second end which is attached to said wall of said intermediate portion; and also includes an egg-engaging member attached to said second end thereof, said clamping members being spaced from said upper and base portions of said support member.

15. A hard boiled egg shelling device as described in claim 11, wherein said base portion of said support member includes a top wall and a bottom wall spaced from said top wall thus forming a compartment therebetween, said top wall having an opening extending therethrough.

16. A hard boiled egg shelling device as described in claim 15, wherein said support member further includes a spring-loaded trap door hingedly attached to said top wall and biasedly closing said opening in said top wall of said base portion and being adapted to allow the hard boiled egg to open said spring-loaded trap door and be received in said compartment.

17. A hard boiled egg shelling device as described in claim 11, wherein said means for removing the hard boiled egg from its shell also includes a shell-piercing member securely attached to an underside of said cap-like member and being adapted to piece and crack the shell of the hard boiled egg.

* * * * *